US009899165B2

(12) United States Patent
Ostmeier et al.

(10) Patent No.: US 9,899,165 B2
(45) Date of Patent: Feb. 20, 2018

(54) SAFETY TEST SWITCH

(71) Applicants: Hubert Ostmeier, Alexandria, VA (US); Emmanuel Ostmeier, Alexandria, VA (US)

(72) Inventors: Hubert Ostmeier, Alexandria, VA (US); Emmanuel Ostmeier, Alexandria, VA (US)

( * ) Notice: Subject to any disclaimer, the term of this patent is extended or adjusted under 35 U.S.C. 154(b) by 0 days.

(21) Appl. No.: 14/880,437

(22) Filed: Oct. 12, 2015

(65) Prior Publication Data

US 2016/0293349 A1 Oct. 6, 2016

Related U.S. Application Data

(60) Provisional application No. 62/062,927, filed on Oct. 12, 2014.

(51) Int. Cl.
*H01H 27/04* (2006.01)
*H01R 9/26* (2006.01)
*H01R 13/703* (2006.01)

(52) U.S. Cl.
CPC ..... *H01H 27/04* (2013.01); *H01R 9/2633* (2013.01); *H01R 9/2666* (2013.01); *H01R 13/7032* (2013.01); *H01R 2201/20* (2013.01)

(58) Field of Classification Search
USPC .... 439/61, 62, 188, 668, 669, 825; 324/126, 324/142, 756, 251, 125, 235, 117 H, 110, 324/117 R, 756.01–756.02, 756.05
See application file for complete search history.

(56) References Cited

U.S. PATENT DOCUMENTS

2005/0250376 A1* 11/2005 Ostmeier ..... G01R 1/0416 439/521
2008/0106266 A1* 5/2008 Diessel ..... H01R 9/2616 324/415
2011/0028031 A1* 2/2011 Bower ..... H01R 13/514 439/540.1
2011/0089961 A1* 4/2011 Ostmeier ..... G01R 15/14 324/754.03

* cited by examiner

*Primary Examiner* — Melissa Koval
*Assistant Examiner* — Nasima Monsur
(74) *Attorney, Agent, or Firm* — Von Rohrscheidt Patents

(57) ABSTRACT

An interface test device for testing a circuit, the interface test device including a module configured to open and close a medium to high voltage monitoring circuit, the module having at least one pair of contacts biased towards each other that are electrically connected and in line with the medium to high voltage monitoring circuit; at least one pair of insulated jacks, wherein the at least one pair of insulated jacks is connected to the medium to high voltage monitoring circuit before or substantially simultaneously with the medium to high voltage monitoring circuit being opened; at least one disconnect plug that is insertable into the module through at least one parking opening into at least one parking position and insertable into the module through at least one disconnect opening into at least one disconnect position.

10 Claims, 10 Drawing Sheets

SAFETY TEST SWITCH

RELATED APPLICATIONS

This application claims priority from and incorporates by reference U.S. Provisional Patent Application No. 62/062,927 filed on Oct. 12, 2014.

FIELD OF INVENTION

The present invention relates generally to an interface test device and method that opens a medium to high voltage circuit, and more specifically to an interface test device that opens a medium to high voltage monitoring circuit where the interface test device is configured to prevent accidental damage to the medium to high voltage monitoring circuit during maintenance and/or allows for maintenance of certain components without taking the medium to high voltage monitoring circuit off line.

BACKGROUND OF THE INVENTION

Most of the components of power system generation, transmission or distribution facilities, such as transmission lines, step-up and step-down transformers, power breakers and generators are monitored and controlled. The control and monitoring is usually performed by electromechanical or electronic equipment that are able to measure electrical quantities, perform calculations based on pre-defined algorithms and thresholds and actuate the system when necessary. Due to the high voltage, current and power flowing through the high-power components, current transformers, potential transformers and breakers are employed as an interface between the high-power components and the low-power control and monitoring devices such as a medium to high voltage monitoring circuit. This medium to high voltage monitoring circuit and its associated circuitry are tested by technicians. For example, a technician might test the operation of a medium to high voltage monitoring circuit or its associated circuitry by inserting a disconnect plug into an interface test device and performing various tests. Unfortunately, it is inevitable that mistakes happen during such testing which results in damage to the equipment or harm to the technician. During such testing, the technician might also adjust the medium to high voltage monitoring circuit by changing the parameters of the medium to high voltage monitoring circuit based upon the testing or based upon other factors. Unfortunately, such testing and adjustments take substantial amounts of the technician's time which is expensive. Furthermore, it is typical to perform periodic maintenance on the circuitry of the medium to high voltage monitoring circuits. In order to perform maintenance on medium to high voltage monitoring circuits, the associated power circuits must be powered down to allow the technician to perform the maintenance since the interface or other components in the medium to high voltage monitoring circuit might otherwise be damaged. These interruptions in operation of the medium to high voltage monitoring circuit and in the power circuit increase the cost of operation. For example, there are costs associated with switching to another power circuit and there are costs associated with the lost usage of the equipment powered by the power circuit. Accordingly, there is a strong need in the art to improve medium to high voltage monitoring circuits and their associated circuitries to reduce or eliminate the aforementioned drawbacks. Several different types of test interfaces are known in the power industry.

One group of test interface types are interfaces which work with single or multi pole disconnect plugs that are not assigned to one individual test interface, yet may be associated by a certain test interface configuration.

Another group of test interface types provides an opening mechanism in every pole of the test interface with the opening mechanism clearly assigned or attached to the test interface.

The invention provides multiple improvements over the inventions described in U.S. Pat. Nos. 8,031,487 and 8,461,856 co-owned by Applicant, both of which are incorporated in their entirety by this reference.

BRIEF SUMMARY OF THE INVENTION

The invention relates to an interface test device for testing a circuit, the interface test device including a module configured to open and close a medium to high voltage monitoring circuit, the module having at least one pair of contacts biased towards each other that are electrically connected and in line with the medium to high voltage monitoring circuit; at least one pair of insulated jacks, wherein the at least one pair of insulated jacks is connected to the medium to high voltage monitoring circuit before or substantially simultaneously with the medium to high voltage monitoring circuit being opened; at least one disconnect plug that is insertable into the module through at least one parking opening into at least one parking position and insertable into the module through at least one disconnect opening into at least one disconnect position, wherein the disconnect plug is electrically insulated from any electrical components of the module when the disconnect plug is inserted into the at least one parking position, wherein the at least one disconnect plug opens the medium to high voltage monitoring circuit when the at least one disconnect plug is inserted into the module in the disconnect position, and wherein the module is configured to provide at least one output based upon at least one parameter of the medium to high voltage monitoring circuit to the at least one pair of jacks in order to measure the at least one parameter by an external tester connected to the at least one pair of jacks.

One object of the invention is to provide a modular assembly, allowing flexible variation of the amount of poles, hence a flexible amount of individual connections to be wired through the test interface according to the invention. The interface modules are designed with one open side that is being closed by an adjacent module. The last interface module of a full test switch assembly is closed by an insulated plastic end plate which does not include any internal parts.

Another object of the invention is to provide a vibration safe connection between a system side and a relay/meter side if the contacts are not opened through the disconnect plugs. Therefore the contact spring which connects both sides is pressed normally closed through two (2) pressure springs.

Another object of the invention is to provide a fully finger safe front of the interface module with no exposed contacts. All the contacts of the interface module are enclosed by insulating plastic material. Insulated disconnect plugs are used to open the enclosed contacts. The insertion of the disconnect plugs provides an opening of the contact springs which at all times works against forming an arc between the contact springs. When removing the disconnect plugs from the disconnect position, the pressure springs automatically force the contact springs back to their normally closed condition. This eliminates the possibility of human error resulting in a contact being unintentionally left open. The disconnect plugs can either have one (1) pole to purely disconnect the contact springs of one module, or the disconnect plugs can be two (2) pole ganged disconnect plugs which include a shorting bridge between both modules and provide a safe shorting of both adjacent system side contact springs, or they can be four (4) ganged disconnect plugs which include a shorting bridge between all four (4) modules and provide a safe shorting of four adjacent system side contact springs. The shorting feature is advantageous for opening current transformer circuits.

Another object of the invention is to prevent an insertion of a one (I) pole disconnect plug into an opening designed for a two (2) or four (4) pole disconnect plug, a two pole disconnect plug into an opening designed for a one (I) or four (4) pole disconnect plug, a four (4) pole disconnect plug into an opening designed for a one (I) or two (2) pole disconnect plug or a two (or four) pole disconnect plug in between two adjacent openings designed for two (or four) pole disconnect plugs. Another object of the invention is to prevent any disconnect plug from upside-down insertion. The invention therefore includes a coding system which prevents false insertion of disconnect plugs. The coding system implements the coding for the module contact opening through a ridge on a backside of an adjacent module. The ridge fits into the contact opening of the module and narrows the opening on one side. Thus, corresponding ridges on the disconnect plugs allow or prevent the disconnect plugs from being inserted into the contact opening.

Another object of the invention is to attach the disconnect plugs to the module according to the invention. Therefore the module includes a parking position for the disconnect plug in each module, wherein the parking position fully insulated from the rest of the internals of the module and adjacent modules.

Another object of the invention is to provide most convenient and flexible access for test procedures, therefore the module includes one (1) or two (2) banana jacks for shielded banana plugs in the top part of each module according to the invention to access all contacts on both system and relay/meter side.

Another object of the invention is to provide convenient test procedures with three (3) fully customizable (in color and inscription) labels for each module on the surface of the top part of the module as well as one on the disconnect plugs and one on the back side of the module.

Another object of the invention is to provide a way to visually confirm a proper opening and closing of the contact springs. Therefore each module includes two (2) openings, or windows on both sides next to the disconnect opening for the disconnect plug to be inserted into the contact springs. Each of the windows includes a groove for optional insertion of a transparent plastic piece to physically close the window without optically closing it.

Another object of the invention is to provide a standardized way of connecting ring lugs on a back side of each module. The module according to the invention therefore includes two (2) screw or stud connectors. Each screw or stud connector includes an external screw thread on the top side which screws into terminal blocks inside the module. Each screw connector includes an internal screw thread on the bottom side to fit standard 8-32 UNC screws to fixate ring lugs. Each stud connector includes an external screw threaded stud on the bottom side to fit standard 8-32 UNC nuts to fixate ring lugs.

Another object of the invention is to prevent the screw connectors from rotating. The module according to the invention therefore includes two (2) plastic fittings within the injection molded module to fit into a groove in the screw or stud connectors.

Another object of the invention is implemented by a safety feature wherein a cover is attachable and interlockable at the module when no disconnect plug is inserted into the module in the at least one disconnect opening. The cover is interlockable at the module by sliding the cover protrusions into the module recesses and moving the cover sideways to lock it. The cover includes a cover bar which prevents the cover from being interlocked at the module as long as any of the disconnect plugs are inserted in the disconnect openings 10 of the test blocks 5. This feature provides additional safety against forgetting disconnect plugs in the disconnect openings of the test blocks.

BRIEF DESCRIPTION OF THE DRAWINGS

The invention is now described in more detail based on an advantageous embodiment with reference to drawing figures, wherein.

DETAILED DESCRIPTION OF THE INVENTION

Monitoring of interface test devices for medium to high voltage circuits and systems according to an exemplary embodiment of the invention may be implemented in an automated manner to provide for more continuous and comprehensive monitoring, greater efficiency and safety, reduced costs associated with the monitoring, as well as other advantages. Furthermore, the circuitry used in monitoring and control of an interface test device also may be configured such that maintenance on the medium to high voltage monitoring circuit is able to be performed safely and efficiently without taking the medium to high voltage monitoring circuit off line. With such monitoring circuitry incorporated into the medium to high voltage monitoring circuit, disruptive maintenance may be avoided because the medium to high voltage monitoring circuit does not need to be taken off line during testing and servicing which means the servicing is performed without interrupting the medium to high voltage monitoring circuit. This improves efficiency and eliminates the problems that would otherwise be caused by these service interruptions.

The interface test device according to an embodiment of the invention also may be implemented such that when a disconnect plug opens the medium to high voltage monitoring circuit, the medium to high voltage monitoring circuit is protected. For example, when a medium to high voltage monitoring circuit is coupled to a power circuit through a transformer with one coil in the power circuit and the other coil in the medium to high voltage monitoring circuit, the medium to high voltage monitoring circuit cannot be opened without the risk of damaging the coil disposed therein. In order to open the medium to high voltage monitoring circuit for maintenance, the power circuit would have to be shut down because otherwise the primary transformer coil in the power circuit will attempt to continue driving current across the effectively infinite impedance of the secondary transformer coil and will produce high voltage across the open secondary transformer coil that can damage components and endanger operators. To avoid such problems, the disconnect plug may be configured to make another circuit before the medium to high voltage circuit is opened. Similarly, other elements including potential transformers and breakers also are protected.

Figure 1:
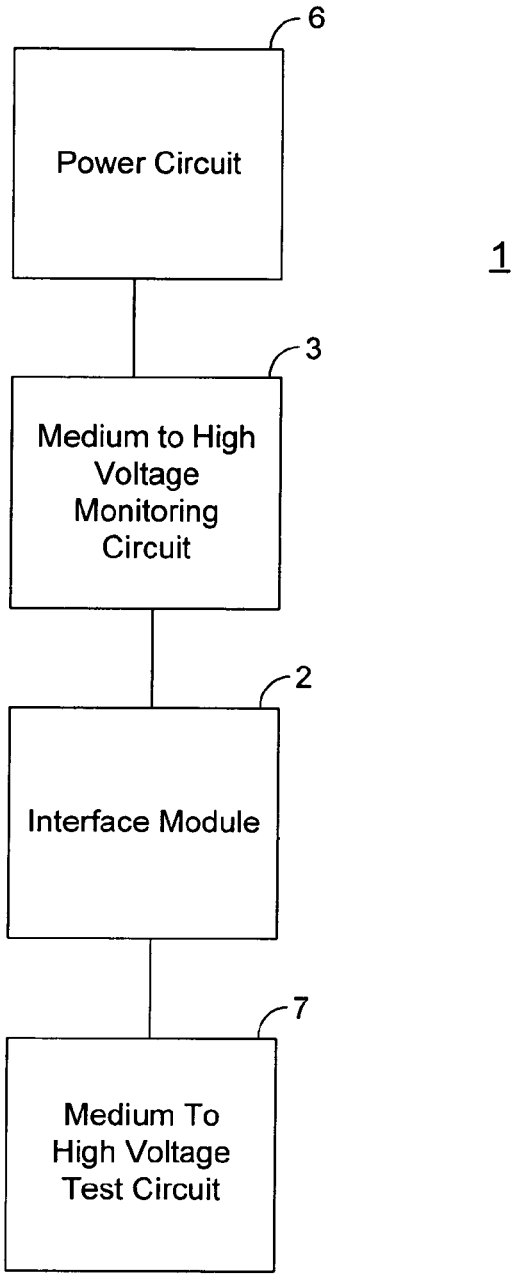
FIG. 1 illustrates a block diagram of an exemplary interface test device according to an embodiment of the invention.

FIG. 1 illustrates a block diagram of an exemplary interface test device 1 according to an embodiment of the invention. The interface test device 1 includes a power circuit 6 monitored by a medium to high voltage monitoring circuit 3, an interface module 2 to connect the medium to high voltage monitoring circuit 3 to a test circuit 7.

Figure 2:
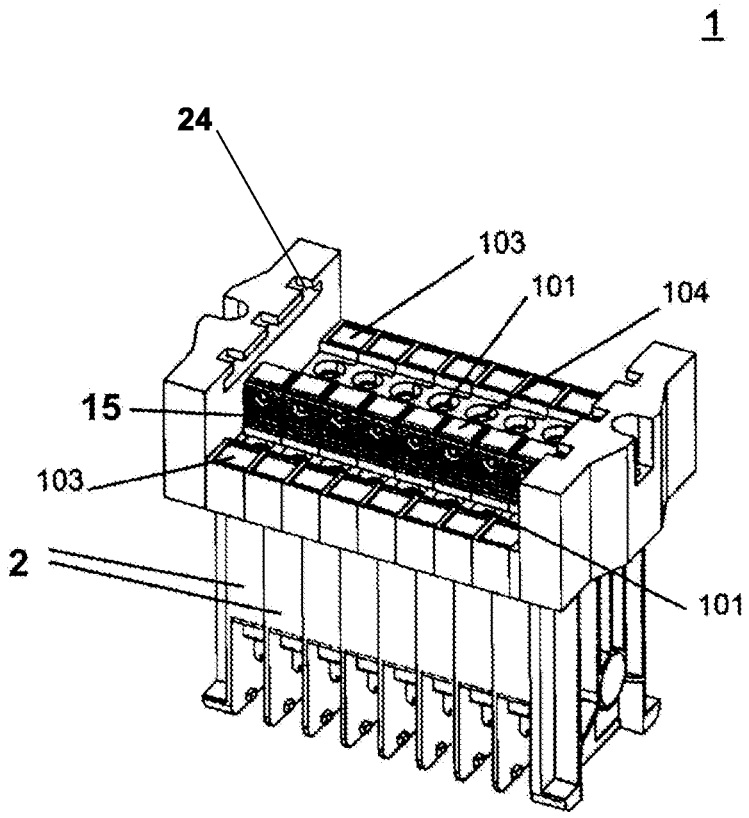
FIG. 2 illustrates a perspective view of an assembly of interface modules according to the invention.

FIG. 2 shows an assembly of the interface modules 2 according to the invention. The invention uses of a variable number of interface modules 2. The invention uses one (1) disconnect plug 15 per module 2. Each module includes one or two insulated banana jacks 101 for test access with shielded banana plugs (not shown). A set of customizable front side plastic labels 103 can be used for description of each module on a front side of the module adjacent to the insertion openings of the disconnect plugs 15. A second set of labels 104 on the disconnect plugs assigns each plug to a corresponding module and a third set of labels 105 (designated in FIG. 3) is on the back of the interface module identifies each interface module by number which facilitates connecting feed wires.

Figure 3:
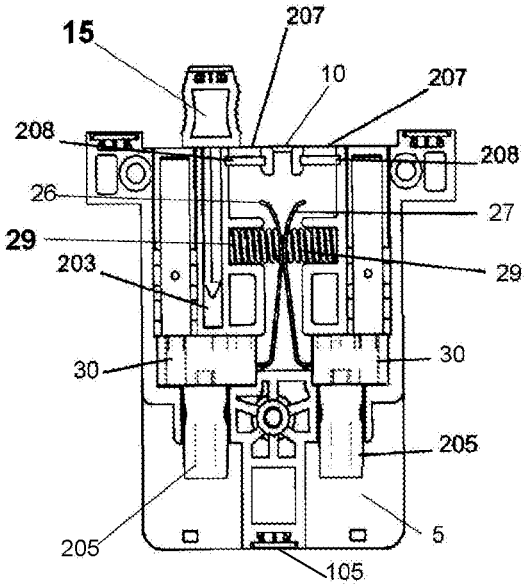
FIG. 3 illustrates a two dimensional view of internal components of an interface module according to the invention.

FIG. 3 illustrates a two dimensional view of internal components of an interface module from an open side of the interface module. In the center of a front side of each interface module there is a disconnect opening 10 for accessing the normally closed contact springs 26 and 27. In the normal state of the interface module with the contact springs 26, 27 are closed, the disconnect plug 15 is stored in the parking opening 11 in the parking position 203. The disconnect plug 15 can be used to open the contact springs 26, 27. Both, the banana jacks 101 (designated in FIG. 4) and the contact springs 26 and 27, are recessed into the modules to provide finger safe insulation and prevent accidental short circuiting of adjacent contacts. The contact springs 26, 27 which may be silver coated copper contact springs are pressed together by two (2) compression springs 29 which may be zinc coated steel compression springs to provide a vibration safe normally closed contact.

Figure 8:
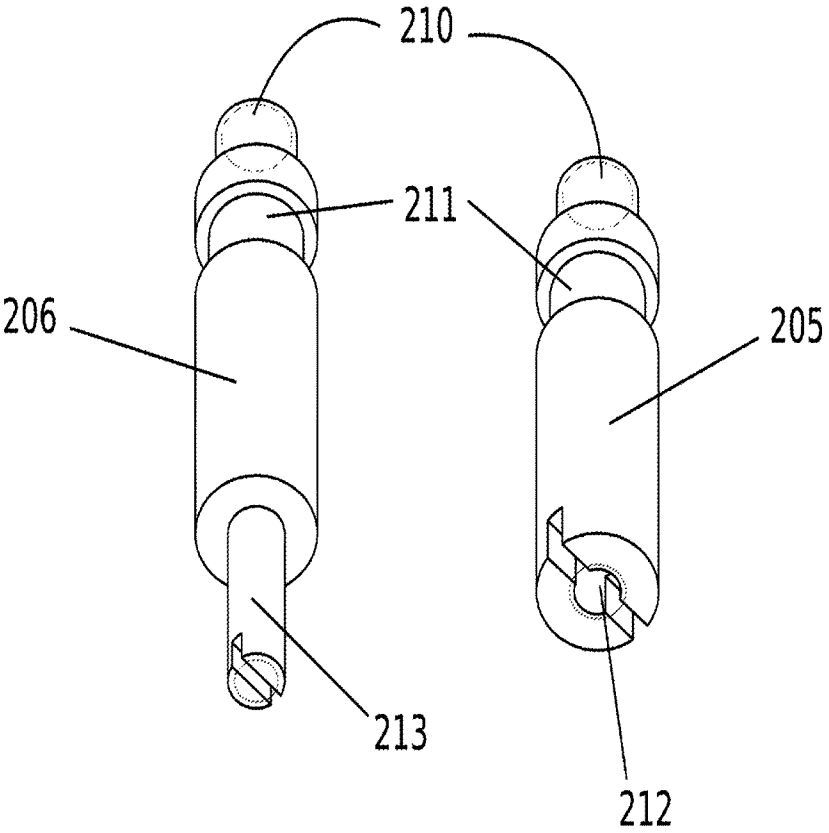
FIG. 8 illustrates an electrical connector according to the invention on a backside of the module.

On a bottom side each interface module 2 includes two (2) screw 205 or stud 206 connectors that are illustrated in more detail in FIG. 8 and that can be threaded into terminal blocks 30 to attach ring lugs (not shown using 8-32 UNC threads 213 or 212. As illustrated in FIG. 8 the connectors have a groove 211 that fits into supports in the injection molded plastic modules to prevent the connectors from unscrewing from terminal blocks 30.

The contacts springs 26, 27, the banana jacks 101 and the connection bolts 205 are fixated at respective terminal blocks 30 to ensure a reliable electrical connection.

Adjacent to the disconnect opening 10 which provides access the normally closed contact springs 26, 27 for the disconnect plug 15, the module includes two viewing openings 207 to enable the user to have a visual path into the module to confirm safe opening of the contact springs 26, 27 after the disconnect plug 15 has been inserted. Each of the viewing openings 207 includes a groove 208 to optionally insert a see-through plastic window which then closes the viewing opening 207 physically but not visually.

It is evident from FIG. 3 that the disconnect plug covers at least one banana jack at least partially when the disconnect plug is inserted in the at least one parking position so that no banana plug can be inserted into the at least one banana jack. This is an added safety feature which prevents operators from inserting two banana plugs into the test block when the contacts of the test block are not shorted by the disconnect plug.

Figure 4:
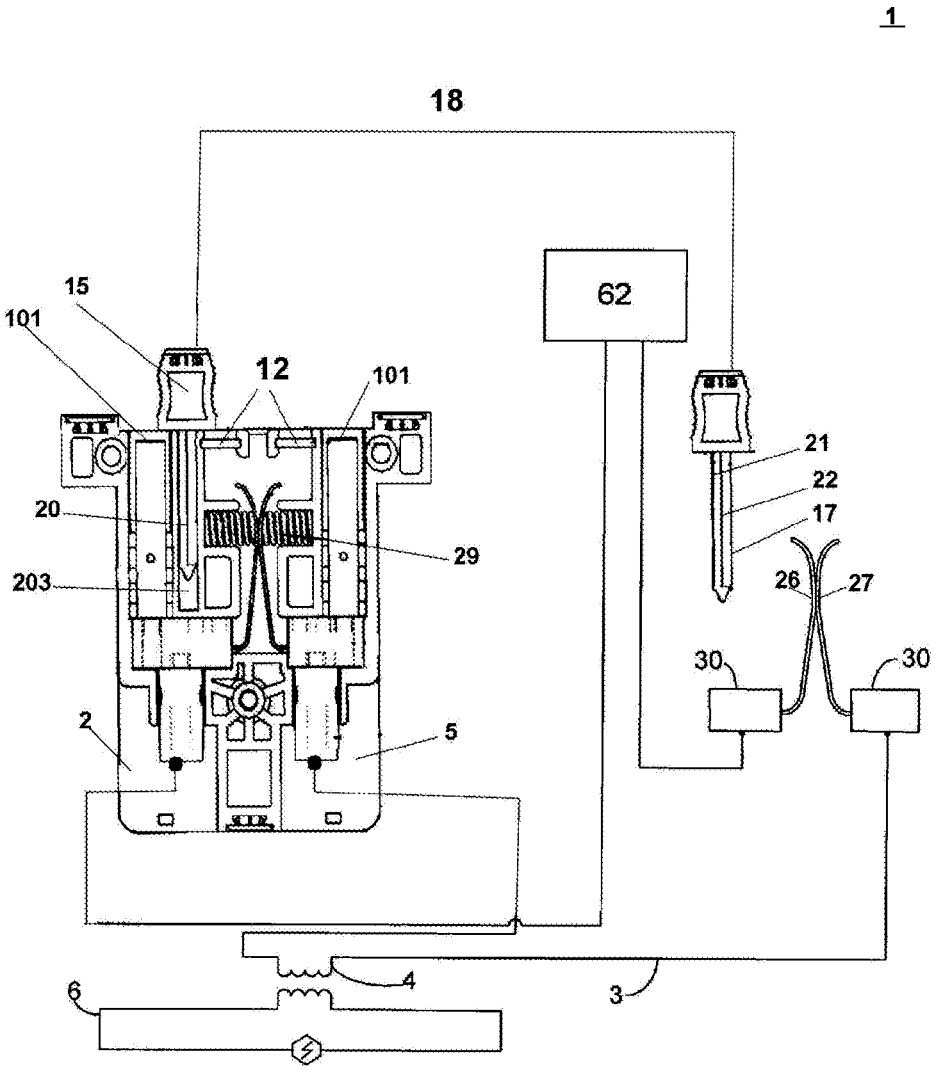
FIG. 4 illustrates an embodiment of the interface test device according to the invention including two interface modules, each interface module with a disconnect plug and a test block where the disconnect plug is inserted into a parking position in the test block.

FIG. 4 illustrates an embodiment of the interface test device 1 including an interface module 2 with two disconnect plugs 15 and two test blocks 5 (also known as test switches or disconnect devices) where the disconnect plugs 15 are inserted into the test blocks 5 in the parking position 203. The interface test device 1 of FIG. 4 includes a medium to high voltage monitoring circuit 3, a monitoring component 4, a power circuit 6, a test circuit 7 (designated in FIG. 6), a disconnect opening 10 (designated in FIG. 3), two disconnect plug A-side contacts 17 (designated in FIG. 6), two shorting bars 18 (designated in FIG. 6) embedded and insulated in the disconnect plugs, two fingers 20 (designated in FIG. 6), two insulators 21 (designated in FIG. 6), two keying features 22 (designated in FIG. 6), two test block B-side biased contacts 26 (designated in FIG. 6), two test block A-side biased contacts 27 (designated in FIG. 6) (test block B-side biased contact 26 and test block A-side biased contact 27 are collectively referred to as a pair of biased contacts 26, 27 and may be formed from a high-quality silver-plated copper contacts, high-quality gold plated copper contacts or any other suitable material or materials), biasing springs 29, terminals 30, and a piece of equipment 62, e.g. a relay to be tested. The two test blocks are used in series. The second test block, which is only partially shown on the right side of FIG. 4 is configured identical to the fully shown test block. The first and the second disconnect plugs can be used to isolate and test the piece of equipment 62. The disconnect plugs 15 may be shaped such that only suitable disconnect plugs 15 will mate with the test blocks 5 via disconnect openings 10 with an optional keying feature 22 on fingers 20. This keying feature 22 prevents inadvertent insertion of unsuitable disconnect plugs that can damage the interface module 2 or other devices and harm the person inserting the unsuitable disconnect plug. Suitable disconnect plugs 15 break the medium to high voltage monitoring circuit 3 and connect the test circuit 7 with the medium to high voltage monitoring circuit 3 substantially simultaneously. The shorting bar 18 of a double (or quadruple) test plug 15 connects two or four A-side biased contact springs 27 of two or four modules. The slanted shape of the tip of finger 20 allows the shorting bar to "make" contact with the A-side biased contact spring 27 before "breaking" the connection between the A-side biased contact spring 27 and the B-side biased contact spring 26, hence providing an automatic "make-before-break" opening sequence. This prevents the medium to high voltage monitoring circuit 3 from ever being interrupted and thus prevents any of the problems that would otherwise result from such an interruption. The disconnect plugs 15 can be inserted into the test blocks 5 for testing potential, current, and signal disconnect links, thereby providing electrical access to all poles on both sides of the test block 5 through the banana jacks 101. The simple, safe, and efficient design of the interface test device provides access to in-service currents without interrupting the current path prior or during disconnect plug insertion.

Additionally, the keying feature 22 assures the various contacts are properly matched such that the test block A-side biased contact 27 is connected to the disconnect plug A-side contact 17. The insulator 21 is disposed between the contact spring 26 and the disconnect plug A-side contact 17. In other words, the finger 20 includes a keying feature 22 that engages the disconnect opening 10 of the test block 5 such that the finger 20 can only be inserted into the disconnect opening 10 in one orientation and the disconnect plug A-side contact 17 of the disconnect plug 15 connects to the test block A-side biased contact 27 of the test block 5 such that a connection with the correct polarity is assured.

The medium to high voltage monitoring circuit 3 is coupled to the power circuit 6 through a monitoring component 4. The pairs of biased contacts 26, 27 are connected to the medium to high voltage monitoring circuit 3 through terminal blocks 30. The disconnect plug 15 includes a finger 21 supporting the disconnect plug contact 17 configured to connect to the biased contact 27 of the medium to high voltage monitoring circuit 3. The disconnect plug contact 17 is connectable to the test circuit 7, for testing the medium to high voltage monitoring circuit 3 including the monitoring component 4 and the piece of equipment 62. The test block 5 and the disconnect plug 15 including the finger 21 may be formed from impact resistant insulator material, such as a plastic (e.g. polypropylene or polyethylene) or any other suitable material that will mechanically support and insulate components of the medium to high voltage monitoring circuit 3 and of the test circuit 7. The materials of the test block 5 may be clear so as to assist in maintenance, detection or sabotage or the like or may be opaque.

The medium to high voltage monitoring circuit 3 operates a monitoring component 4, such as a secondary coil of a transformer, which is used for monitoring a power circuit 6 with the primary coil disposed in the power circuit 6 and the secondary coil disposed in the medium to high voltage monitoring circuit 3 and couples the medium to high voltage monitoring circuit 3 to the power circuit 6. This protects the monitoring and control components 4 from damage because the higher voltages and/or currents in the power circuit 6 would damage or destroy the monitoring and control components 4 in the medium to high voltage monitoring circuit 3 if directly applied. For example, a current transformer may be used to monitor the power circuit 6 when the current and/or voltage in the power circuit 6 is too high to directly apply to measuring instruments in the medium to high voltage monitoring circuit 3 or in the test circuit 7. A current transformer and/or other elements may be used to produce a reduced current that is accurately proportional to the current in the power circuit 6 that can be conveniently connected to measuring and recording instruments in the medium to high voltage monitoring circuit 3 and in the test circuit 7. For example, the secondary winding of a current transformer should not be disconnected from its load while current is flowing in the primary winding in the power circuit 6, as the current transformer will attempt to continue driving current across the effectively infinite impedance and produce a very high voltage in the secondary current transformer coil that will permanently damage the current transformer and significantly compromise operator and equipment safety.

The test block 5 includes a disconnect opening 10 configured to receive a finger 20 of the disconnect plug 15. The test block 5 also houses a pair of biased contacts 26, 27 that act as disconnect links that normally connect the medium to high voltage monitoring circuit 3 to external terminals 30.

The terminal blocks 30 may be configured to receive standard connectors or other connectors. The finger 20 may be made of impact resistant insulator material such as polypropylene, polyethylene or any other suitable material, and the finger may be configured to insulate against the voltages of the medium to high voltage monitoring circuit 3. As illustrated in FIG. 4, the pair of biased contacts 26, 27 in the test block 5 are in the closed position. In the closed position, the pair of biased contacts 26, 27 are securely pressed together by their own tension and may be additionally pressed together by one or two biasing springs 29 acting substantially against the opening direction of the pair of biased contacts 26, 27 and exerting force from one or both sides to create a constant contact pressure that minimizes internal resistance. The pair of biased contacts 26, 27 may be spread apart and disconnected from one another by insertion of the finger 20 of the disconnect plug 15 between the pair of biased contacts 26, 27.

Figure 5:
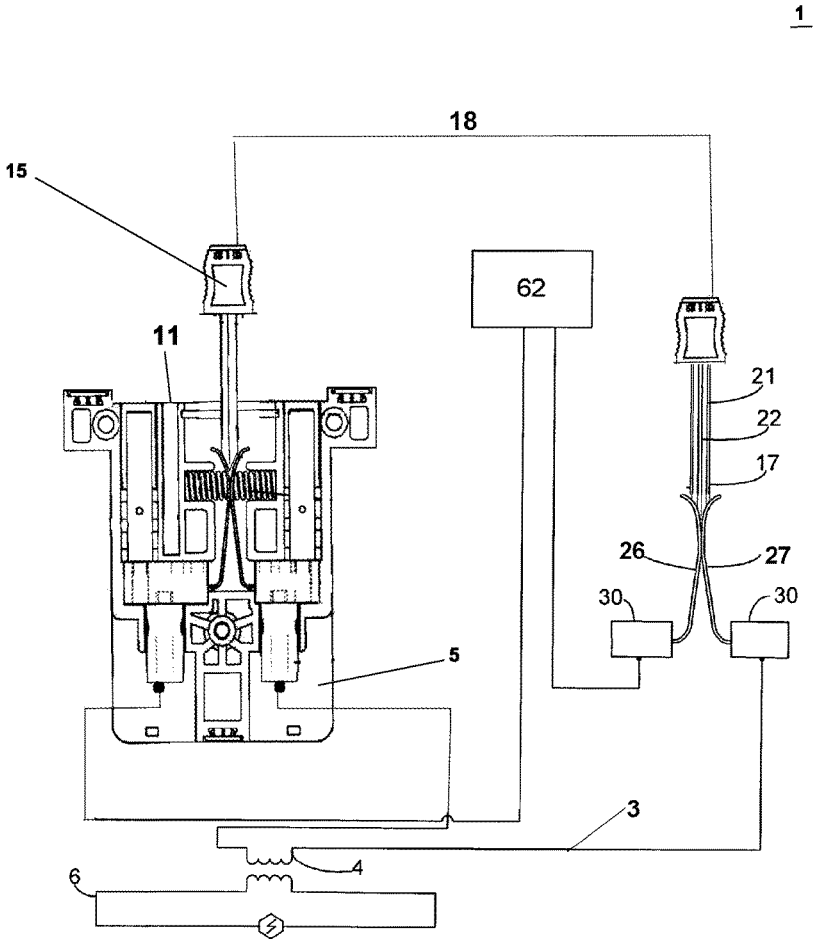
FIG. 5 illustrates an embodiment of the interface test device according to the invention where the disconnect plugs are partially inserted into the disconnect positions in the test blocks.

FIG. 5 illustrates an embodiment of the interface test device 1 where the disconnect plugs 15 are partially inserted into the test blocks 5. Specifically, the disconnect plugs 15 have been inserted into disconnect openings 10 (labeled in FIG. 3) of the test blocks 5 where the disconnect plug contact 17 contacts the biased contact 27 of the test block 5 but does not cause the pair of biased contacts 26, 27 to separate. The disconnect plug contact 17 being in contact with the biased contact 27 short-circuits the medium to high voltage monitoring circuit 3 through the disconnect plug A-side contact 17 of the disconnect plugs 15 and the shorting bar 18, which acts as a safety precaution to protect the monitoring circuit 3 and the test circuit and helps to prevent an electric arc from forming when the contacts 26, 27 are opened.

Figure 6:
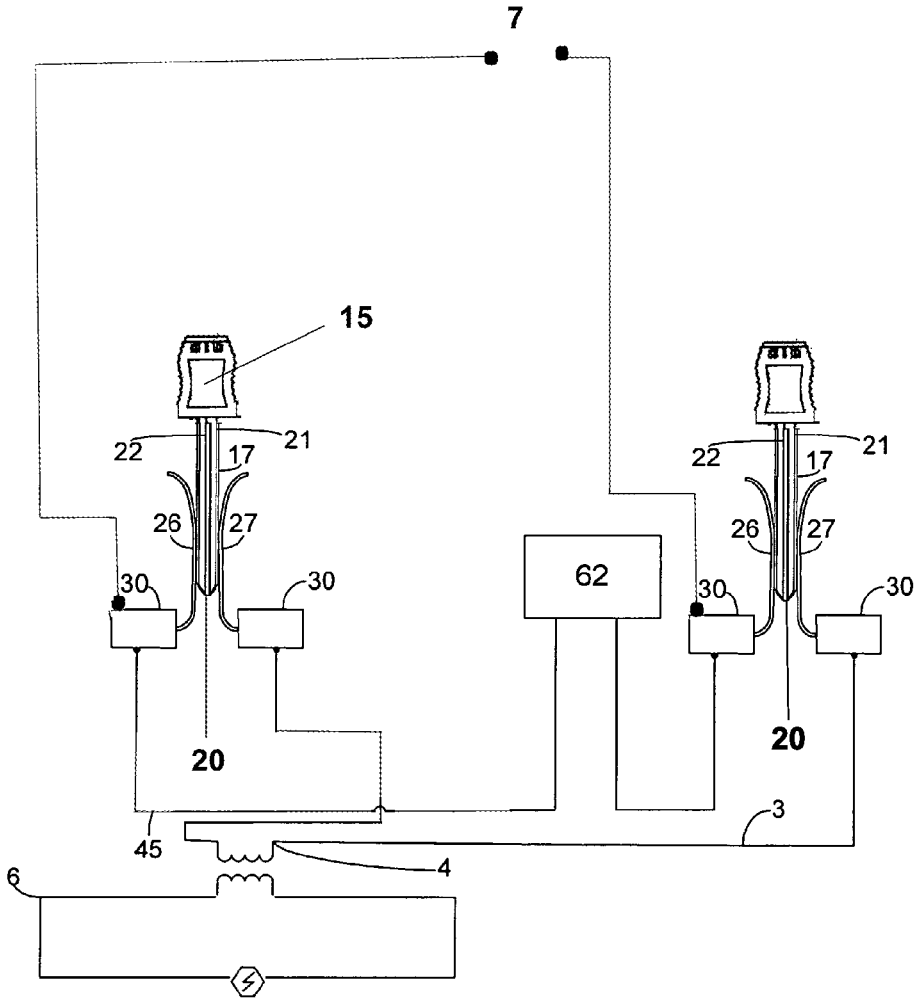
FIG. 6 illustrates the interface test device where the disconnect plugs are fully inserted into the disconnect positions in the test blocks.

FIG. 6 illustrates the interface module 2 of FIG. 1 with the disconnect plugs 15 fully inserted into the test blocks 5. For the purpose of clarity the plastic housing of the test block is not shown. The disconnect plug B-side contact 17 connects to the test block B-side biased contact 27 of the medium to high voltage circuit 3 and the pair of biased contacts 26, 27 are separated. This means that the test block B-side biased contacts 27 are connected to the disconnect plug B-side contact 17 and thus are short-circuited by the shorting bar 18 and thus may be used for testing. Now the piece of equipment 62 is connected to the test circuit 7 and accessible through the B-side banana jacks 101 (designated in FIG. 4) of the test blocks 5.

Full insertion of the disconnect plug 15 into the test block 5 as illustrated in FIG. 6 pushes the finger 20 between the pair of biased contacts 26, 27 and separates the pair of biased contacts 26, 27 from each other causing the opening of the medium to high voltage monitoring circuit 3 and thereby connecting the left side banana jacks 101 of the test blocks 5 to the test circuit 7 and simultaneously isolating the device to be tested in the same motion. For reasons of clarity the banana jacks 101 are not shown in FIG. 6 and the test circuit is shown to connect directly to the terminal blocks 30. The insertion of the finger 20 between the pair of biased contacts 26, 27 occurs against the natural direction of the electric arc opening between the pair of biased contacts 26, 27 and inserts an insulator 21 between the two poles of the pair of biased contacts 26, 27 which guarantees that no electric arc occurs while the pair of biased contacts 26, 27 is being opened. The interface test device 1 is designed to perform a "make-before-break" function, where make means shorting the current transformer ends. This "make-before-break" function provides superior protection for current transformers and other circuit elements. For example, upon insertion of the disconnect plug 15, the pair of biased contacts 26, 27 is automatically short-circuited by the shorting bar 18 along pre-assigned poles, in a single step. The simple, safe, and efficient design of the disconnect plug 15 and the test block 5 provides access to in-service medium to high voltage monitoring and control components 4 and the equipment 62 without interrupting the current path prior or during disconnect plug 15 insertion. The interface test device 1 utilizes "make-before-break" function to maintain electrical system continuity and automatically short circuit medium to high voltage component current channels before opening the medium to high voltage monitoring and control circuit 3. Potential and signal links are disconnected by the disconnect plug 15 with high quality electrical insulation. The single movement of disconnect plug 15 insertion both "makes" and "breaks" the medium to high voltage circuit 3 in a fail-safe sequence that achieves proper isolation and restoration every time. With the disconnect plug 5 inserted as illustrated in FIG. 6, testing and replacement of a defective medium to high voltage monitoring component 4 and of the equipment 62 can be safely performed.

The pair of biased contacts 26, 27 automatically closes upon removal of the disconnect plug 15 from the disconnect position. For example, the biasing springs 29 that press the pair of biased contacts 26, 27 towards each other guarantee that the medium to high voltage monitoring circuit 3 is closed when the testing procedures are finished.

The use of multiple disconnect plugs 15 allows for the testing of portions of the test circuit 7. Alternatively, if the entire test circuit is to be tested, a single multi-pole disconnect plug may be used.

Figure 7:
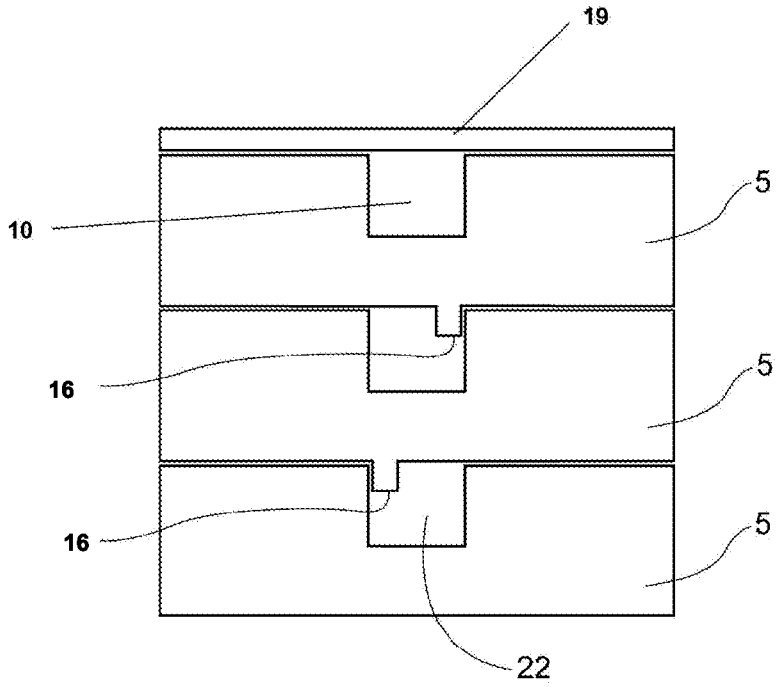
FIG. 7 illustrates a keying feature of the disconnect opening of the module.

FIG. 7 illustrates the keying feature 22. A keying protrusion 16 from an adjacent module extends into a disconnect opening 10 of the module to be keyed and matches with a keying feature of a finger of a disconnect plug. This assures that only correct disconnect plugs with correct orientation can be inserted into respectively keyed disconnect openings 10. The last module of a module assembly is closed by a cover plate 19. The cover plate 19 can also be provided with the keying feature.

FIG. 8 illustrates the screw connector 205 and stud connector 206 in detail as described supra. The screw and stud connector have an external M6×0.75 thread 210 at their top ends that screws into the terminal block 30. The screw and stud connector further include a groove 211 which fits into plastic fittings of the mold injection plastic modules to avoid unscrewing of the connector 205 and 206 from the terminal block 30. The screw connector 205 includes an internal thread 212 to fit standard 8-32 UNC screws to fixate ring lugs. The stud connector 206 includes an external thread 213 to fit standard 8-32 UNC nuts to fixate ring lugs.

Figure 9:
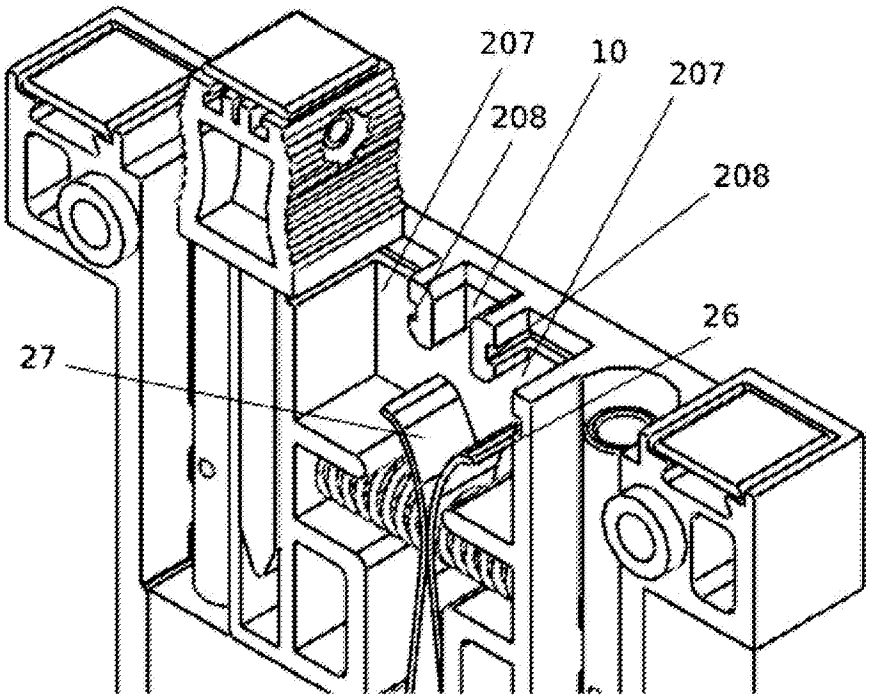
FIG. 9 illustrates a mounting option for an plastic window plate.

FIG. 9 illustrates the viewing opening 207 in more detail. Next to each disconnect opening 10, the test block according to the invention provides two viewing openings 207 to allow the operator visual confirmation of the status of the A-side biased contact spring 26 and the B-side biased contact spring 27. A groove 208 in each viewing opening 207 allows the insertion of a see-through plastic window 12 as illustrated in FIG. 4. This plastic window mechanically closes the viewing opening 207 without compromising the visual path. Alternatively a non see-through plastic window 12 as illustrated in FIG. 4 can be used to close the viewing opening 207 mechanically and visually.

Figure 10:
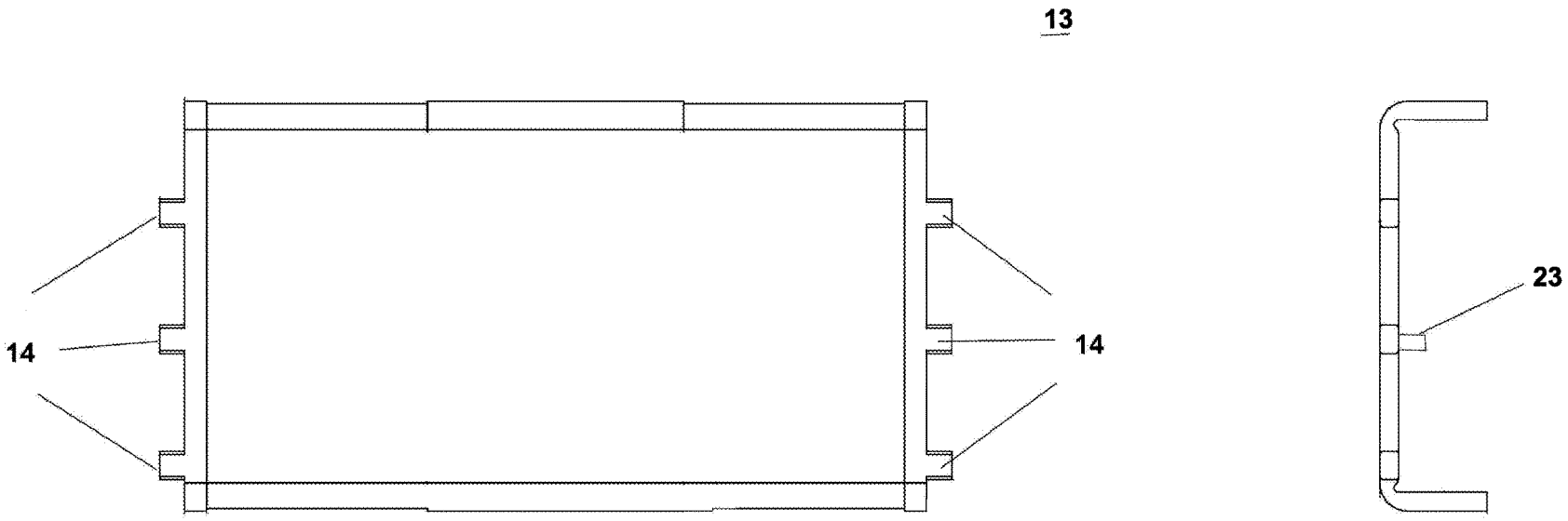
FIG. 10 illustrates a safety cover for the interface test device.

FIG. 10 illustrates a dust- and safety cover 13. FIG. 3 illustrates that the cover 13 is interlockable at the module 1 by sliding the cover protrusions 14 into the test block recesses 24 and moving the cover sideway to lock it. The cover includes a cover bar 23 which prevents the cover from being interlocked at the module as long as any of the disconnect plugs 15 are inserted in the disconnect openings of the test blocks 10. When trying to interlock the cover 13 in the test block recesses 24 with the disconnect plugs 15 inserted into the test blocks 5 the cover bar hits the disconnect plugs 15 which prevents the interlocking. Thus, the cover 13 stays visually open which provides additional safety against forgetting disconnect plugs in the disconnect openings 10 of the test blocks 5.

Although several embodiments of the present invention and its advantages have been described in detail, it should be understood that changes, substitutions, transformations, modifications, variations, permutations and alterations may be made therein without departing from the teachings of the present invention, the spirit and the scope of the invention being set forth by the appended claims.

REFERENCE NUMERALS AND DESIGNATIONS

1 interface test device
2 interface module
3 medium to high voltage monitoring circuit
4 monitoring component
5 test block
6 power circuit
7 test circuit
10 disconnect opening
11 parking opening
12 plastic window
13 cover
14 cover protrusion
15 disconnect plug
16 module protrusion
17 disconnect plug A-side contact
18 shorting bar
19 cover plate
20 finger
21 insulator
22 keying feature
23 cover bar
24 test block recess for cover
26 A-side biased contact spring
27 B-side biased contact spring
29 compression spring
30 terminal block
62 equipment to be tested
101 banana jack
103 label on front of interface module
104 label on disconnect plug
105 label on back of interface module
203 parking position
205 screw connector
206 stud connector

207 viewing opening
208 groove
210 M6×0.75 thread
211 groove
212 internal 8-32 UNC thread
213 external 8-32 UNC thread

What is claimed is:

1. An interface test device for testing a circuit, the interface test device comprising:

a module configured to open and close a medium to high voltage monitoring circuit, the module having at least one pair of contacts biased towards each other that are electrically connected and in line with the medium to high voltage monitoring circuit;

at least one pair of insulated jacks, wherein the at least one pair of Insulated jacks is connected to the medium to high voltage monitoring circuit before or substantially simultaneously with the medium to high voltage monitoring circuit being opened;

at least one disconnect plug that is insertable into the module through at least one parking opening into at least one parking position and insertable into the module through at least one disconnect opening into at least one disconnect position; and at least one viewing opening adjacent to the at least one disconnect opening, wherein the disconnect plug is electrically insulated from any electrical components of the module when the disconnect ping is inserted into the at least one parking position, wherein the at least one disconnect plug opens the medium to high voltage monitoring circuit when the at least one disconnect plug is inserted into the module in the at least one disconnect position, wherein the module is configured to provide at least one output based upon at least one parameter of the medium to high voltage monitoring circuit to the at least one pair of jacks in order to measure the at least one parameter by an external tester connected to the at least one pair of jacks, and wherein the at least one viewing opening allows a visual determination whether the at least one pair of contacts are in conductive contact with each other or not in conductive contact with each other.

2. The device according to claim 1, wherein the medium to high voltage monitoring circuit may be serviced for maintenance without being interrupted.

3. The device according to claim 1, wherein a side of the module is closed by an adjacent module or by a cover plate.

4. The device according to claim 1, wherein identification labels are provided on one disconnect plug, the module adjacent to the at least one disconnect opening or on a backside of the module.

5. The device according to claim 1, wherein the viewing opening is covered by a transparent piece of plastic.

6. The device according to claim 1, wherein the viewing opening is covered by a non transparent piece of plastic.

7. The device according to claim 1, wherein the jacks are banana jacks.

8. An interface test device for testing a circuit, the interface test device comprising:

a module configured to open and close a medium to high voltage monitoring circuit, the module having at least one pair of contacts biased towards each other that are electrically connected and in line with the medium to high voltage monitoring circuit;

at least one pair of insulated jacks, wherein the at least one pair of insulated jacks is connected to the medium to high voltage monitoring circuit before or substantially simultaneously with the medium to high voltage monitoring circuit being opened; and at least one disconnect plug that is insertable into the module through at least one parking opening into at least one parking position and insertable into the module through at least one disconnect opening into at least one disconnect position, wherein the disconnect plug is electrically insulated from any electrical components of the module when the disconnect plug is inserted into the at least one parking position, wherein the at least one disconnect plug opens the medium to high voltage monitoring circuit when the at least one disconnect plug is inserted into the module in the at least one disconnect position, wherein the module is configured to provide at least one output based upon at least one parameter of the medium to high voltage monitoring circuit to the at least one pair of jacks in order to measure the at least one parameter by an external tester connected to the at least one pair of jacks, wherein the module includes terminal blocks that are respectively connected to the biased contacts, wherein ring lug connectors are threaded into the terminal blocks, wherein the cable ring lug connectors include grooves that are supported by protrusions of the module, and wherein the ring lug connectors include standard 8-32 UNC internal or external threads at their bases.

9. An interface test device for testing a circuit, the interface test device comprising:

a module configured to open and close a medium to high voltage monitoring circuit; the module having at least one pair of contacts biased towards each other that are electrically connected and in line with the medium to high voltage monitoring circuit;

at least one pair of insulated jacks, wherein the at least one pair of insulated jacks is connected to the medium to high voltage monitoring circuit before or substantially simultaneously with the medium to high voltage monitoring circuit being opened; and at least one disconnect plug that is insertable into the module through at least one parking opening into at least one parking position and insertable into the module through at least one disconnect opening into at least one disconnect position, wherein the disconnect plug is electrically insulated from any electrical components of the module when the disconnect plug is inserted into the at least one parking position, wherein the at least one disconnect plug opens the medium to high voltage monitoring circuit when the at least one disconnect plug is inserted into the module in the at least one disconnect position, wherein the module is configured to provide at least one output based upon at least one parameter of the medium to high voltage monitoring circuit to the at least one pair of jacks in order to measure the at least one parameter by an external tester connected to the at least one pair of jacks, wherein the disconnect plug covers at least one banana jack at least partially when the disconnect plug is inserted in the at least one parking position so that no banana plug can be inserted into the at least one banana jack.

10. An interface test device for testing a circuit, the interface test device comprising:

a module configured to open and close a medium to high voltage monitoring circuit, the module having at least one pair of contacts biased towards each other that are electrically connected and in line with the medium to high voltage monitoring circuit;

at least one pair of insulated jacks, wherein the at least one pair of insulated jacks is connected to the medium to high voltage monitoring circuit before or substantially simultaneously with the medium to high voltage monitoring circuit being opened; and at least one disconnect plug that is insertable into the module through at least one parking opening into at least one parking position and insertable into the module through at least one disconnect opening into at least one disconnect position, wherein the disconnect plug is electrically insulated from any electrical components of the module when the disconnect plug is inserted into the at least one parking position, wherein the at least one disconnect plug opens the medium to high voltage monitoring circuit when the at least one disconnect plug is inserted into the module in the at least one disconnect position, wherein the module is configured to provide at least one output based upon at least one parameter of the medium to high voltage monitoring circuit to the at least one pair of jacks in order to measure the at least one parameter by an external tester connected to the at least one pair of jacks, and wherein a cover is attachable and interlockable at the module when no disconnect plug is inserted into the module in the at least one disconnect opening.

* * * * *